US006415501B1

(12) United States Patent
Schlesselman et al.

(10) Patent No.: US 6,415,501 B1
(45) Date of Patent: Jul. 9, 2002

(54) HEATING ELEMENT CONTAINING SEWN RESISTANCE MATERIAL

(76) Inventors: John W. Schlesselman, S 3104 N. Shore Dr., Fountain City, WI (US) 54629; Ronald E. Papenfuss, R.R. 4 Box 197A, Winona, MN (US) 55987; Theodore Von Arx, Rte. 1, Box 170, La Crescent, MN (US) 55947

( * ) Notice: Subject to any disclaimer, the term of this patent is extended or adjusted under 35 U.S.C. 154(b) by 0 days.

(21) Appl. No.: 09/416,731

(22) Filed: Oct. 13, 1999

(51) Int. Cl.[7] ..... H05B 3/00

(52) U.S. Cl. ..... 29/611; 29/610.1; 219/548; 219/529; 219/528

(58) Field of Search ..... 29/610.1, 611; 219/549, 545, 528, 529, 553

(56) References Cited

U.S. PATENT DOCUMENTS

| | | | | |
|---|---|---|---|---|
| 1,058,270 | A | 4/1913 | Stephens | 219/217 |
| 2,202,095 | A | 5/1940 | Delhaye et al. | 219/217 |
| 2,593,087 | A | 4/1952 | Baggett | 219/217 |
| 2,804,533 | A | 8/1957 | Nathanson | 219/34 |
| 3,061,501 | A | 10/1962 | Dittman et al. | 156/250 |
| 3,385,959 | A | 5/1968 | Ames et al. | |
| 3,623,471 | A | 11/1971 | Bogue et al. | 126/263.01 |
| 3,657,516 | A | 4/1972 | Fujihara | 219/345 |
| 3,781,526 | A | 12/1973 | Damron | 219/538 |
| 3,806,701 | A | 4/1974 | Scott | 219/438 |
| 3,875,373 | A | 4/1975 | Lowery et al. | 219/526 |
| 3,888,711 | A | 6/1975 | Breitner | 156/93 |
| 3,908,749 | A | 9/1975 | Williams | 165/61 |
| 4,055,516 | A | 10/1977 | Kiyokawa et al. | 264/22 |
| 4,119,834 | A | 10/1978 | Losch | 392/418 |
| 4,158,078 | A | 6/1979 | Egger et al. | 428/102 |
| 4,233,495 | A | 11/1980 | Scoville et al. | 219/386 |
| 4,245,149 | A | 1/1981 | Fairlie | 219/528 |
| 4,304,987 | A | 12/1981 | van Konynenburg | 219/553 |
| 4,321,296 | A | 3/1982 | Rougier | 428/212 |
| 4,346,277 | A | 8/1982 | Wojtecki et al. | 219/528 |
| 4,388,607 | A | 6/1983 | Toy et al. | 338/22 SD |
| 4,390,551 | A | 6/1983 | Swartley et al. | 426/107 |
| 4,658,121 | A | 4/1987 | Horsma et al. | 219/553 |
| 4,762,980 | A | 8/1988 | Insley | 219/307 |
| 4,784,054 | A | 11/1988 | Karos et al. | 99/483 |
| 4,797,537 | A | 1/1989 | Berthelius et al. | 219/528 |
| 4,845,343 | A | 7/1989 | Aune et al. | 219/545 |
| 4,972,197 | A | 11/1990 | McCauley et al. | 343/704 |
| 4,982,064 | A | 1/1991 | Hartman et al. | 219/727 |
| 4,983,814 | A | 1/1991 | Ohgushi et al. | 219/545 |
| 5,023,433 | A | 6/1991 | Gordon | 219/548 |
| 5,068,518 | A | 11/1991 | Yasuda | 219/549 |
| 5,094,179 | A * | 3/1992 | Badillo | 112/114 |
| 5,111,025 | A | 5/1992 | Barma et al. | 29/217 |
| 5,271,085 | A | 12/1993 | Carballo | 392/444 |
| 5,582,754 | A | 12/1996 | Smith et al. | 219/438 |
| 5,780,820 | A | 7/1998 | Komyoji et al. | 219/543 |
| 5,824,996 | A | 10/1998 | Kochman et al. | 219/529 |
| 5,880,435 | A | 3/1999 | Bostic | 219/387 |
| 5,902,518 | A | 5/1999 | Khazai et al. | 252/511 |
| 5,940,895 | A | 8/1999 | Wilson et al. | 4/237 |
| 6,037,574 | A | 3/2000 | Lanham et al. | 219/544 |
| 6,056,157 | A | 5/2000 | Gehl et al. | 222/94 |
| 6,089,406 | A | 7/2000 | Feldner | 222/103 |
| 6,147,332 | A | 11/2000 | Holmberg et al. | 219/526 |
| 6,229,123 | B1 | 5/2001 | Kochman et al. | 219/549 |

FOREIGN PATENT DOCUMENTS

FR 2 737 380 1/1997

OTHER PUBLICATIONS

International Search Report dated Nov. 21, 2001.
International Search Report dated Dec. 5, 2001.

* cited by examiner

*Primary Examiner*—Peter Vo
*Assistant Examiner*—Sean Smith
(74) *Attorney, Agent, or Firm*—Duane Morris LLP

(57) ABSTRACT

Heating elements, electrical devices and processes for manufacturing these components are provided. The heating elements and electrical components employ a resistance heating material, such as Ni-Cr wire, sewn with a thread to a supporting substrate, such as a non-woven glass mat. The sewn thread supports the relatively thin cross-section of the resistance material when a fusible layer is applied, such as by molding a polymer under pressure.

19 Claims, 4 Drawing Sheets

HEATING ELEMENT CONTAINING SEWN RESISTANCE MATERIAL

CROSS-REFERENCE TO RELATED APPLICATIONS

This Application is related to U.S. application Ser. Nos. 09/369,779, filed Aug. 6, 1999, and U.S. application Ser. No. 09/275,161, filed Mar. 24, 1999, which are hereby incorporated by reference.

FIELD OF THE INVENTION

This invention relates to electric resistance heating elements, and more particularly, to thermoplastic insulated resistance heating elements containing supporting substances.

BACKGROUND OF THE INVENTION

Electric resistance heating elements are available in many forms. A typical construction includes a pair of terminal pins brazed to the ends of a Ni-Cr coil, which is then axially disposed through a U-shaped tubular metal sheath. The resistance coil is insulated from the metal sheath by a powdered ceramic material, usually magnesium oxide. While such conventional heating elements have been the workhorse for the heating element industry for decades, there have been some widely-recognized deficiencies. For example, galvanic currents occurring between the metal sheath and any exposed metal surfaces of a hot water tank can create corrosion of the various anodic metal components of the system. The metal sheath of the heating element, which is typically copper or copper alloy, also attracts lime deposits from the water, which can lead to premature failure of the heating element. Additionally, the use of brass fittings and copper tubing has become increasingly more expensive as the price of copper has increased over the years. What's more, metal tubular elements present limited design capabilities, since their shape can not be significantly altered without losing performance.

As an alternative to metal elements, polymeric heating elements have been designed, such as those disclosed in U.S. Pat. No. 5,586,214. The '214 patent describes a process of making a polymeric heater in which an inner mold is used having a plurality of threaded grooves for receiving a resistance wire. The assembly is first wound with a wire and thereafter injection molded with an additional coating of thermoplastic material, containing a large amount of ceramic powder for improving the thermal conductivity of the coating.

It has been discovered that injection molding a layer of thermoplastic material loaded with large amounts of ceramic powder can be difficult. The viscous polymeric material often fails to fill the mold details and can leave portions of resistance wire coil exposed. Additionally, there can be insufficient wetting between the over molded thermoplastic coating and the resistance wire, with minimal thermoplastic bonding between the inner mold and the over molded thermoplastic coating. This has led to failure of such elements during thermal cycling, since entrapped air and insufficient bonding create crack initiation sites. Crack initiation sites lead to stress cracks that can lead to shorts in emersion applications. Cracks and entrapped air also limit the heating elements' ability to generate heat homogeneously, which tends to create hot and cold spots along the length of the element.

Efforts have been made to minimize hot and cold spots and insufficient bonding between layers of plastic materials having electrical resistance heaters disposed between their layers. In U.S. Pat. No. 5,389,184, for example, a pair of thermosetting composite structures are bonded together using a heating element containing a resistance heating material embedded within two layers of thermoplastic adhesive material. The two thermosetting components are permitted to cure, and then while applying pressure to the joint, electrical energy is passed through the heating element sufficient to heat the joint to above the melting temperature of the thermoplastic adhesive material. This heat fuses the layers of the thermoplastic adhesive to join the thermosetting materials together. The heating element remains within the joint after bonding and provides a mechanism to reheat the joint and reverse the bonding process in the field.

While these procedures have met with some success, there remains a need for a less expensive, and more structurally sound, electrical resistance heating element.

SUMMARY OF THE INVENTION

The present invention provides resistance heating elements containing a supporting substrate having a first surface thereon. An electrical resistance material is sewn with a thread to the supporting substrate to form a pre-determined circuit path having a pair of terminal end portions. Finally, a fusible layer is disposed over the circuit path and a portion of the supporting surface whereby the thread assists in retaining the resistance material in the pre-determined circuit path at least during the encapsulation by the fusible layer.

The sewing methods employed by this invention create element precursors which are more durable, easier to mold around, and flexible. The element precursors of this invention, because of the stitching used to hold the resistance heating wire onto the substrate, are much more efficient to produce and avoid the labor associated with setting pins in a fibrous material to hand wind the resistance heating wire. The efficiency of such a process cannot be understated, since up to 10–500 stitches per minute can be made to attach resistance heating material to any number of substrate types, including those containing glass fibers, thermoplastic and thermosetting materials. Because of the efficiency and accurate placement of the resistance wires sewn onto substrates with the present invention, multi-layered heating elements can be produced efficiently and accurately. Such multi-layered elements could include electrical resistance heating elements having different watt densities, thermocouples, heat distribution layers, insulation layers, metallic layers, thermistors, sensors, electronics, microchips, and fiber-optic devices without risking reliability.

In another aspect of the present invention, a method of making an insulated electrical component is provided in which an electrical resistance heating wire having a relatively thin cross-section is sewn to a supporting substrate with a thread to form a circuit path of an element precursor. The circuit path is then overmolded with a polymeric material whereby the sewn thread supports the electrical resistance wire during molding. Such molding techniques can include, for example, injection molding, blow molding, extrusion or rotational molding.

A BRIEF DESCRIPTION OF THE DRAWINGS

The accompanying drawings illustrate preferred embodiments of the invention, as well as other information pertinent to the disclosure, in which:

FIG. 1(*a*) is a front plan, enlarged view, of a portion of the element precursor of FIG. 1, showing the preferred cross-stitch attachment to the supporting substrate;

DETAILED DESCRIPTION OF THE INVENTION

The present invention provides heating elements useful as emersion heaters for liquids, contact heaters for paper, towels, or human beings, heaters for industrial and commercial applications, fitable insoles for footwear, as well as other consumer devices. As used herein, the following terms are defined:

"Substantially Encapsulating" means that at least 85 percent of the surface area of the designated member is provided with polymeric material, but does not necessarily mean that the coating is hermetic;

"Serpentine Path" means a path which has one or more curves for increasing the amount of electrical resistance material in a given volume of polymeric matrix, for example, for controlling the thermal expansion of the element;

"Melting Temperature" means the point at which a fusible substance begins to melt;

"Melting Temperature Range" means the temperature range over which a fusible substance starts to melt and then becomes a liquid or semi-liquid;

"Degradation Temperature" means the temperature at which a thermoplastic or thermosetting polymer begins to permanently lose its mechanical or physical properties because of thermal damage to the polymer's molecular chains;

"Evacuating" means reducing air or trapped air bubbles by, for example, vacuum or pressurized inert gas, such as argon, or by bubbling the gas through a liquid polymer.

"Fusion Bond" means the bond between two fusible members integrally joined, whereby the polymer molecules of one member mix with the molecules of the other. A Fusion Bond can occur, even in the absence of any direct or chemical bond between individual polymer chains contained within said members;

"Fused" means the physical flowing of a material, such as ceramic, glass, metal or polymer, hot or cold, caused by heat, pressure or both;

"Electrofused" means to cause a portion of a fusible material to flow and fuse by resistance heating;

"Stress Relief" means reducing internal stresses in a fusible material by raising the temperature of the material or material portion above its stress relief temperature, but preferably below its Heat Deflection Temperature.

Element Embodiment

Figure 1:
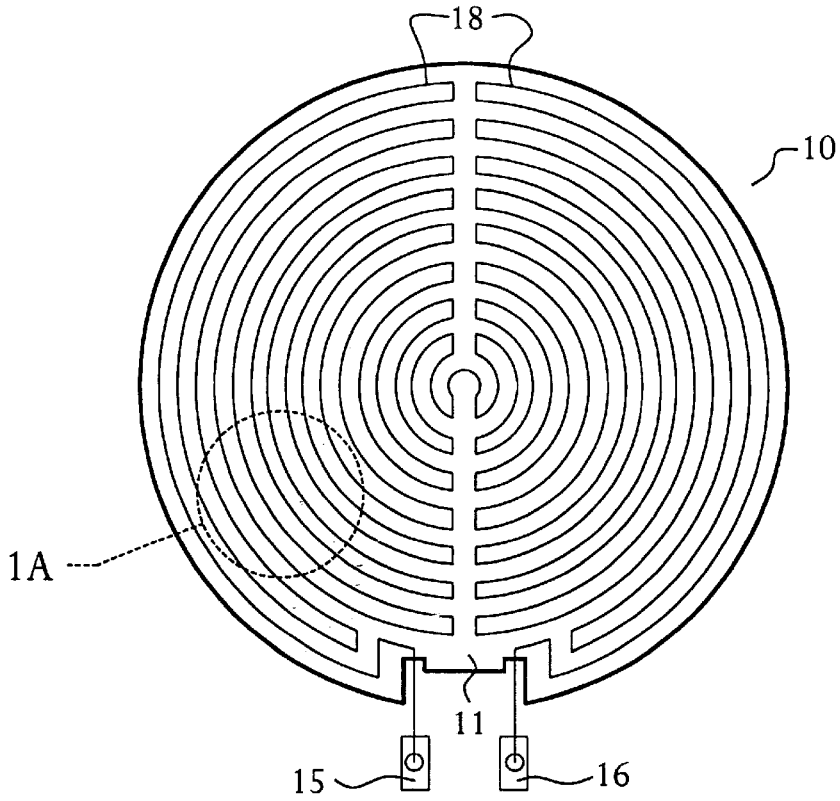
FIG. 1 is a front plan view of a preferred element precursor, including a resistance wire disposed in a circuit path on a supporting substrate and joined to a pair of electrical connectors.
Figure 1A:
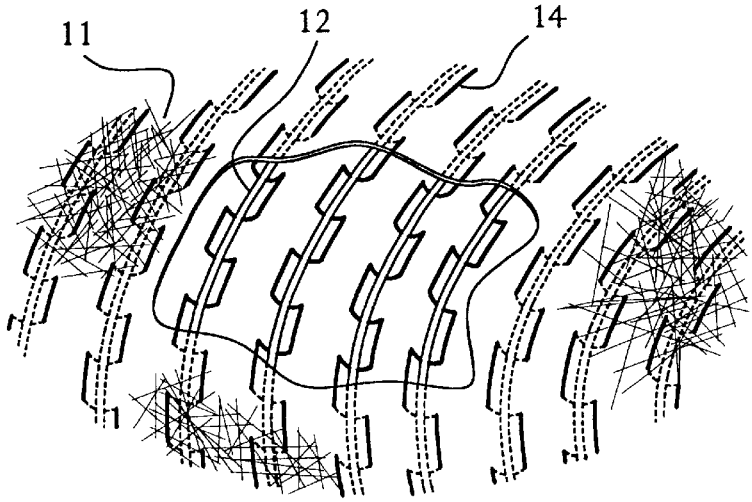
Figure 2:
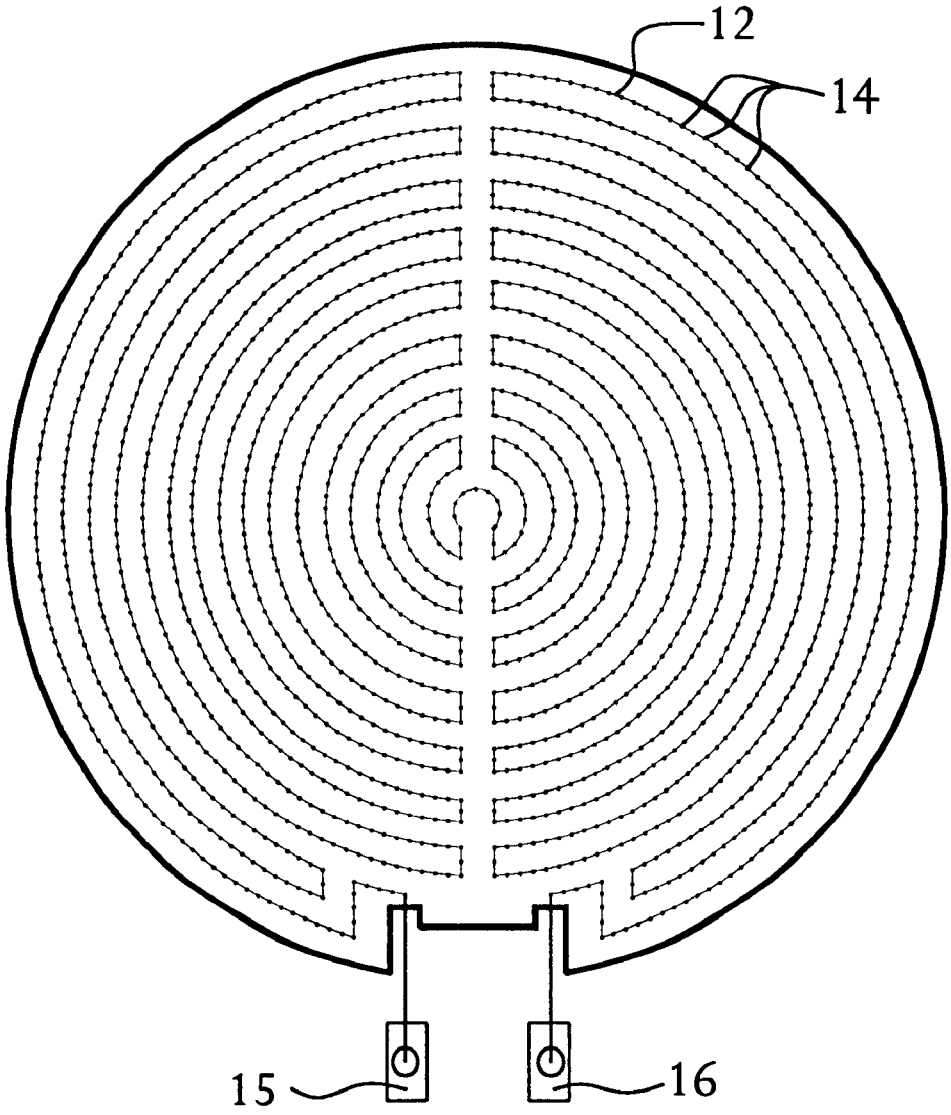
FIG. 2 is a rear plan view of the element.

With reference to the Figures, and particularly FIGS. 1, 1*a* and 2 thereof, there is shown a first embodiment of a element 10 precursor having a diameter of about 11 cm. The preferred element 10 precursor may include a regulating device for controlling electric current. Such a device can include, for example, a thermistor, or a thermocouple, for preventing overheating of the polymeric materials disclosed in this invention. The element precursors 10 of this invention can take on any number of shapes and sizes, including squares, ovals, irregular circumference shapes, tubes, cup shapes and containers. Sizes can range from less than one inch square to 21 in. ×26 in. with a single sewing operation, and greater sizes can be available if multiple elements are joined together.

As shown in FIG. 1, the precursor element 100 includes a resistance wire 12 disposed in a helical pattern or circuit path 18. The ends of the resistance wire 12 arc generally riveted, grommeted, brazed, or welded to a pair of electrical connectors 15 and 16. One preferred circuit path of the heating element 25 of its invention is illustrated in FIGS. 1 and 2. The circuit includes a resistance heating material, which is ideally a resistance heating wire 12 wound into a serpentine path containing about 3–200 windings, or, a resistance heating material, such as ribbon a foil or printed circuit, or powdered conducting or semi-conducting metals, polymers, graphite, or carbon, or a conductive coating or ink. More preferably the resistance heating wire 12 includes a Ni-Cr alloy, although certain copper, steel, and stainless-steel alloys could be suitable. The resistance heating wire 12 can be provided in separate parallel paths, or in separate layers. Whatever material is selected, it should be electrically conductive, and heat resistant.

Fusible and Polymeric Layers

The fusible layers of this invention are preferably polymeric, but can contain any heat resistant, thermally conductive and preferably non-electrically conductive materials, such as ceramics, (such as those discussed herein), clays, glasses, and semi-conductive materials, such as gallium arsenide or silicon. Additionally, cast or wrought metals, such as aluminum, copper, brass, zinc and tin, or combinations thereof, could be used, if the resistance wire or material is insulated in a coating such as glass, ceramic, or high temperature polymer.

Figure 5:
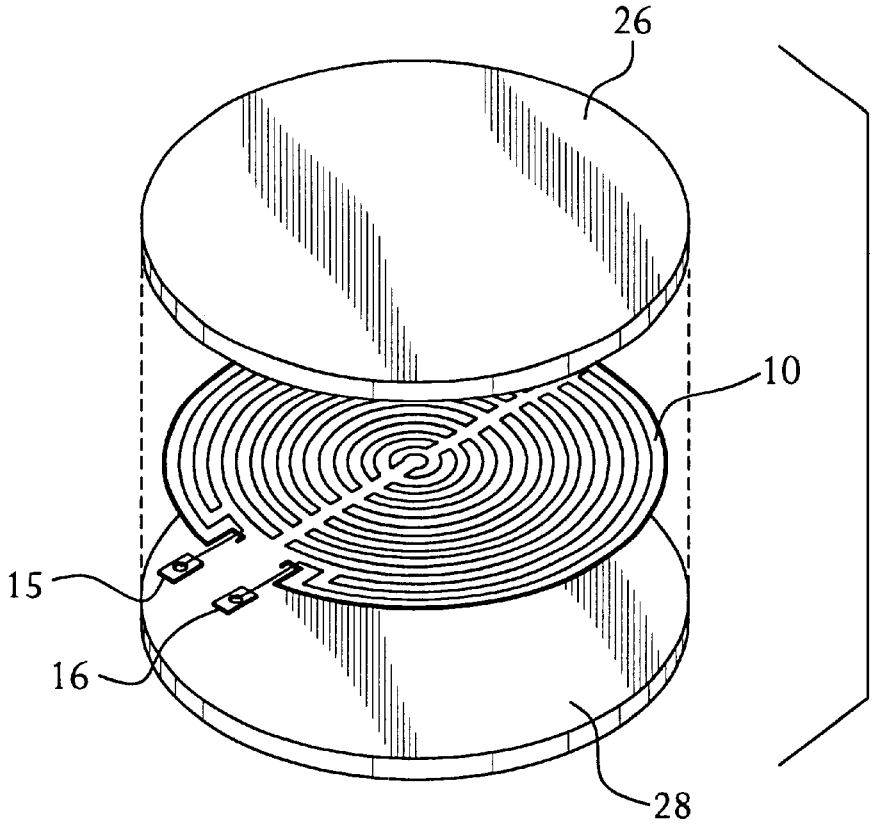
FIG. 5 is a top perspective and exploded view of the heating element described in FIG. 4.

The preferred polymeric layers of this invention, including top and bottom polymeric layers 26 and 28 of FIG. 5, are preferably made from a high-temperature polymeric resin including a melting or degradation temperature of greater than 93° C. (200° F.). High temperature polymers known to resist deformation and melting at operating temperatures of about 75–85° C. are particularly useful for this purpose. Both thermoplastics and thermosetting polymers can be used. Good choices include polymeric materials and compositions that are injection moldable, since they are already known to behave well during melting and reforming operations. Preferred thermoplastic materials include, for example: fluorocarbons, polypropylene, polycarbonate, polyetherimide, polyether sulphone, polyaryl-sulphones, polyimides, and polyetheretherkeytones, polyphenylene sulfides, polyether sulphones, and mixtures and co-polymers of these thermoplastics. Preferred thermosetting polymers include epoxies, phenolics, and silicones. Liquid-crystal polymers can also be employed for improving high-temperature use. Also useful for the purposes of this invention are compression, prepegs, or sheet molding compounds of epoxy reinforced with about 5–60wt% glass fiber. A variety of commercial epoxies are available which are based on phenol, bisphenol, aromatic diacids, aromatic polyamines and others, for example, Litex 930, available from Quantum Composites, Midland, Mich.

It is further understood that, although thermoplastic plastics are most desirable for the purposes of this invention because they are generally heat-flowable, some thermoplastics, notably polytetraflouroethylene (PTFE) and ultra high-molecular-weight polyethylene (UHMWPE) do not flow under heat alone. Also, many thermoplastics are capable of flowing without heat, under mechanical pressure only. On the other hand, thermosetting polymers are usually heat-settable, yet many thermosetting plastics such as silicone, epoxy and polyester, can be set without being heated. Another thermosetting material, phenolic, must first be made to flow under heat, like a thermoplastic, before it can be heat-set.

As stated above, the polymeric layers of this invention preferably also include reinforcing fibers, such as glass, carbon, aramid, steel, boron, silicon carbide, polyethylene, polyamide, or graphite fibers. The fibers can be disposed throughout the polymeric material in amounts of about 5–75 wt% prior to molding or forming the final heating element 25, and can be provided in single filament, multifilament thread, yarn, roving, non-woven or woven fabric.

In addition to reinforcing fibers, this invention contemplates the use of thermally conducting, preferably non-electrically conducting, additives in amounts of about 5–80 wt%. The thermally-conducting additives desirably include ceramic powder such as, for example, $A1_2O_3$, MgO, $ZrO_2$, Boron nitride, silicon nitride, $Y_2O_3$, SiC, $SiO_2$, $TiO_2$, etc., or a thermoplastic or thermosetting polymer which is more thermally conductive than the polymer suggested to be used with the top and bottom polymeric layers 26 and 28. For example, small amounts of liquid-crystal polymer or polyphenylene sulfide particles can be added to a less expensive base polymer such as epoxy or polyvinyl chloride, to improve thermal conductivity, Alternatively copolymers, alloys, blends, and interpenetrating polymer networks (IPNs) could be employed for providing improved thermal conductivity, better resistance to heat cycles and creep.

Substrates

As used herein, the term "supporting substrate" refers to the base material on which the resistance material, such as wires, of this invention are applied. The supporting substrate 11 of this invention should be capable of being pierced, penetrated, or surrounded, by a sewing needle for permitting the sewing operation. Other than this mechanical limitation, the substrates of this invention can take on many shapes and sizes. Flat flexible substrates can be used for attaching electrical resistance wire with a thread, prior to bending the substrate in a mold and overmolding with a thermoplastic or thermosetting material. Non-plastic materials, such as ceramics, glasses, semiconductive materials, and metals, can be employed so long as they have a piercable cross-sectional thickness, e.g., less than 10–20 mil, or a high degree of porosity or openings therethrough, such as a grid, scrim, woven or nonwoven fabric, for permitting the sewing needle of this invention to form an adequate stitch. The supporting substrate 11 of this invention need not necessarily contribute to the mechanical properties of the final heating element 25, but may contain high strength fibers such as those described above for reinforcing the polymeric layers 26 and 28 of this invention. Such fibers could contain carbon, glass, aramid fibers melt-bonded or joined with an adhesive to form a woven or non-woven mat. Alternatively, the supporting substrate 11 of this invention may contain ordinary, natural, or synthetic fibers, such as cotton, wool, silk, rayon, nylon, polyester, polypropylene, polyethylene, etc. The advantage of using ordinary textile fibers, is that they are available in many thicknesses and textures and can provide an infinite variety of chemistry, porosity and melt-bonding ability. The fibers of this invention, whether they be plastic, natural, ceramic or metal, can be woven, or spun-bonded to produce non-woven textile fabrics, alternatively, clay, such as modeling clay can be used and later fired to provide an element precursor after an electrical resistance material is bonded to the clay surface.

Specific examples of supporting substrates 11 useful in this invention include non-woven fiberglass mats bonded with an adhesive or sizing material such as model 8440 glass mat available from Johns Manville, Inc. Additional substrates can include polymer impregnated fabric, such as raw printed circuit board laminate, polymer or organic fabric weaves, such as those containing nylon, rayon, hemp or rubber, etc., porous ceramic wafers, porous mica-filled plate or sheet, and thermoplastic or thermosetting sheet film material. In one preferred embodiment of this invention, the supporting substrate 11 contains a polymeric resin which is also used in either the top polymeric layer 26 or bottom polymeric layer 28, or both. Such a resin can be provided in woven or non-woven fibrous form, or in thin sheet material having a thickness of 20 mil. or less. Thermosetting and thermoplastic material can be used for the supporting substrate 11 which will melt-bond or liquefy in the subsequent molding operation with the polymeric material of the top or bottom polymeric layers 26 and 28, so as to blend into a substantially uniform composition, preferably without a visible seam at 10 X magnification.

Sewing Operation

Figure 3:
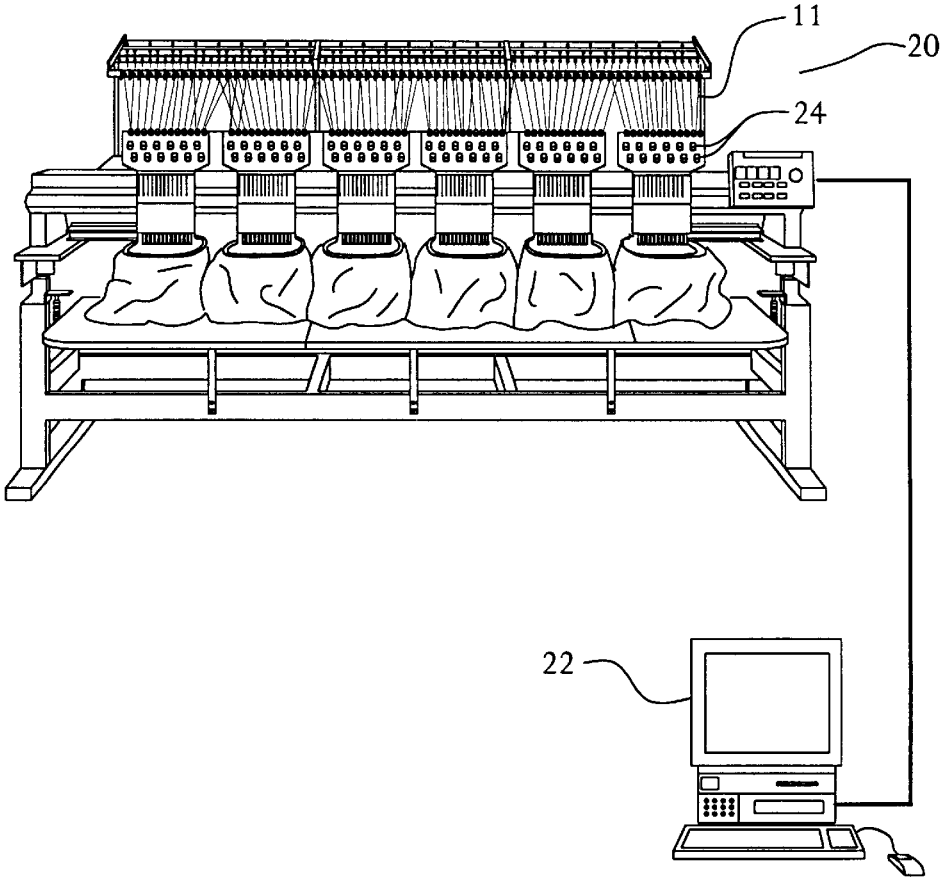
FIG. 3 is an front perspective view of a preferred programmable sewing machine and computer for manufacturing element precursors.

With reference to FIG. 3, the preferred programmable sewing machine 20 will now be described. The preferred programmable sewing machine is one of a number of powerful embroidery design systems that use advanced technology to guide an element designer through design creation, set-up and manufacturing. The preferred programmable sewing machine 20 is linked with a computer 22, such as a personal computer or server, adapted to activate the sewing operations. The computer 22 preferably contains or has access to, embroidery or CAD software for creating thread paths, borders, stitch effects, etc.

The programmable sewing machine 20 includes a series of bobbins for loading thread and resistance heating wire or fine resistance heating ribbon. Desirably, the bobbins are prewound to control tension since tension, without excessive slack, in both the top and bottom bobbins is very important to the successful capturing of resistance heating wire on a substrate. The thread used should be of a size recommended for the preferred programmable sewing machine. It must have consistent thickness since thread breakage is a common mode of failure in using programmable sewing machines. An industrial quality polyester or rayon thread is highly desirable.

The programmable sewing machine of this invention preferably has up to 6–20 heads and can measure 6 foot in width by 19 feet long. The sewing range of each head is about 10.6 inches by 26 inches, and with every other head shut off, the sewing range is about 21 inches by 26 inches. A desirable programmable sewing machine is the Tajima Model No. TMLG116-627W (LT Version) from Tajima, Inc., Japan.

The preferred method of capturing a resistance heating wire 12 onto a supporting substrate 11 in this invention will now be described. First, an operator selects a proper resistive element material, for example, Ni-Cr wire, in its proper form. Next, a proper supporting substrate 11, such as 8440 glass mat, is provided in a form suitable for sewing. The design for the element is preprogrammed into the computer 22 prior to initiating operation of the programmable sewing machine 20. As with any ordinary sewing machine, the programmable sewing machine 20 of this invention contains at least two threads, one thread is directed through the top surface of the supporting substrate, and the other is directed from below. The two threads are intertwined or knotted, ideally somewhere in the thickness of the supporting substrate 11, so that one cannot view the knot when looking at the stitch and the resulting element precursor. As the top needle penetrates the substrate 11 and picks up a loop of thread mechanically with the aid of the mechanical device underneath, it then pulls it upward toward the center of the substrate 11 and if the substrate is consistent and the thread tension is consistent, the knots will be relatively hidden. In a preferred embodiment of this invention, the resistance heating wire 12 is provided from a bobbin in tension. The preferred programmable sewing machine 20 of this invention provides a third thread bobbin for the electrical resistance wire 12 so that the programmable sewing machine 20 can lay the resistance wire 12 down just in front of the top needle. The preferred operation of this invention provides a zig zag or cross stitch, as shown in FIG. 1A, whereby the top needle criss-crosses back and forth as the supporting substrate 11 is moved, similar to the way an ornamental rope is joined to a fabric in an embroidery operation. The sewing with the top needle over either side of the resistance heating wire 12 captures it in a very effective manner and the process is all computer controlled so that the pattern can be electronically downloaded into the computer 22 and automatically sewn onto the substrate of choice. The thickness of the substrate is therefore only limited by the top dead-center stroke of the top needle, so fairly thick substrates in the range of up to 0.5 inches, or substrates that have a wavy surface or a texture could be used.

The programmable sewing machine 20 of this invention can sew a electrical resistance wire 12, 5 mil–0.25 inch in diameter or thickness, onto a supporting substrate 11 at a rate of about 10–500 stitches per minute, saving valuable time and associated cost in making element precursors. One application envisioned is to create a heated toilet seat. Such a seat could contain an element having about 5,800 stitches Using the techniques of this invention an element precursor for a heated toilet seat can be fabricated in about 15–20 minutes per head, allowing for the fabrication of 8–16 element precursors for this application in about 15 minutes.

Construction Techniques

Figure 4:
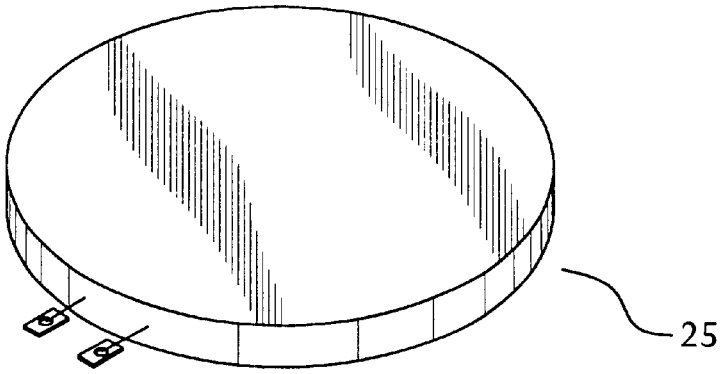
FIG. 4 is a top perspective view of a preferred heating element embodiment.

As shown in FIGS. 4 and 5, the heating element 25 of this invention can be fabricated in sections including a top polymeric layer 26, bottom polymeric layer 28 and element precursor 10. Preferred molding techniques include compression molding, injection molding, blow molding, extrusion or rotational molding, for example. Additionally, the element precursor can be fused or electrofused to the top and bottom polymeric layers 26 and 28 by vacuuming forming or using the electrical energy provided by the circuit path 18 when electrically energized through the electrical conductors 15 and 16. For many of the molding techniques of this invention, it is relatively important that the supporting substrate 11 permit flowing polymer to pass through the substrate to create a single integrated heated product. In most applications, the porosity of the supporting substrate is important. When non-woven or woven fibrous mats are used, an air permeability rating of at least about 1,000 cubic feet per minute is a desirable degree of porosity. It will be envisioned that operators will need to adjust the porosity of the supporting substrate 11 in order to permit a molten polymer with a known viscosity to pass through the pores of the substrate. For example, a fabricated heating element 25 possessing a highly porous substrate, such as an open mesh glass fiber fabric, will be more conducive to a high processing viscosity polymeric material, whereas a more tight knit fabric or thermoplastic film, for example, will result in a low porosity substrate, requiring a low processing viscosity material, or alternatively, a melt or fused bond.

The ability to mechanically attach resistive elements, such as wires, films and ribbons, to substrates opens up a multitude of design possibilities in both shape and material selection. The present invention permits designers to mix and match substrate materials by selecting their porosity, thickness, density and contoured shape with selected resistance heating materials ranging in cross-section from very small diameters of about 5 mil to rectangular and irregular shapes, to thin films.

Alternatively, circuits, including microprocessors, fiberoptic fibers or optoelectronic devices, (LEDs, lasers) microwave devices (power amplifiers, radar) and antenna, high temperature sensors, power supply devices (power transmission, motor controls) and memory chips could be added for controlling temperature, visual inspection of environments, communications, and recording temperature cycles, for example. The overall thickness of the element precursor is merely limited by the vertical maximum position of the needle end, less the wire feed, which is presently about 0.5 inches, but may be designed in the future to be as great as 1 inch or more. Resistive element width is not nearly so limited, since the transverse motion of the needle can range up to a foot or more.

Examples of heating element designs afforded by the expediencies of this invention include applying an electrical resistance heating wire with a highly thermally conductive coating, such as ceramic, to a glass mat. This element precursor could then be molded between a pair of thermoplastic or thermosetting sheets and molded into a net shape.

Alternatively, a spun resistance heating wire could be sewn onto a polymer impregnated sheet, such as G10 or FR4 printed circuit board substrate available in various pre-preg forms. The resulting sheet can then be vacuum formed. A further embodiment of this invention can be created by embroidering a resistance wire to a thick ceramic grid substrate. An additional wire could also be attached to the substrate prior to overmolding the element precursor with a high temperature, non-conductive material, such as glass. While not containing a thermoplastic material, this high temperature design could have practical applications in harsh environments.

A further embodiment of this invention could include wrapping a resistance heating wire with an insulating material, such as fiberglass yarn, prior to joining the wire to a metallic film, such as aluminum foil. This element precursor could then be placed between sheets of polymer and molded or vacuum formed into a net shape. In still a further embodiment of this invention, a wire could be sewn to a pre-preg of printed circuit laminate material which is thereafter compression molded into a very thin flat shape suitable for use in a typical injection molding operation. Such a method would construct a mechanically rigid element assembly that could withstand the high velocity material flow indicative of injection molding.

This invention also encompasses the joining of resistance wire or ribbon material to a softer material, such as clay. The resulting element precursor can be contoured into a multi-dimensional shape, such as a tube or cup with or without overlaying similar materials, such as further layers of clay. The precursor with the overlay can be formed or molded, and then fired to cure and create a final net shape, such as self-heating pottery or food service equipment. Other designs can create multi-dimensional contoured net shapes from a flat precursor made of thermoplastic or thermosetting materials which are later formed prior to final setting. Flat sheets of heated materials could also be created for HVAC, or medical applications, such as sterilizing trays or the like.

In view of the foregoing, it can be realized that this invention provides improved methods of manufacturing resistance heating elements. The preferred embodiments of this invention teach a sewing process where the resistance heating element material is applied to a substrate and held in place with a preferred cross-stitch of thread applied by a programmable sewing machine. The use of known embroidery machinery in the fabrication of element precursors allows for a wide variety of raw materials and substrates to be combined with various resistance heating materials. This invention provides the ability to manufacture multi-layered substrates, including embedded metallic and thermally conductive layers with resistance wires wrapped in an electrically insulating coating, so as to avoid shorting of electric current. This permits the application of a resistance heating wire to both sides of the thermally conductive metallic layer, such as aluminum foil, for more homogeneously distributing resistance heat. Although various embodiments have been illustrated, this is for the purpose of describing, but not limiting the invention. Various modifications which will become apparent to one skilled in the art, are within the scope of this invention described in the attached claims.

We claim:

1. A method of making an insulated, electrical component, comprising the steps of:

(a) providing an electrical device having a relatively thin cross-section;

(b) sewing said electrical device to a supporting substrate with a thread to form an element precursor having a circuit path;

(c) mechanically deforming at least said circuit path; and (d) substantially encapsulating at least said circuit path within a fusible layer, whereby said sewn thread supports said electrical device when said fusible layer is applied; wherein the shape of said circuit path is mechanically deformed prior to the encapsulating step (d).

2. The method of claim 1 wherein said encapsulation step comprises compression molding, injection molding, blow molding, extrusion or rotational molding.

3. The method of claim 1 wherein said supporting substrate comprises a non-woven or woven fibrous mat, having an air permeability rating of at least about 1,000 cubic feet per minute.

4. The method of a claim 3, wherein said electrical device comprises carbon, graphite or Ni-Cr resistance heating wire, and said fusible layer comprises a filled thermosetting resin.

5. The method of claim 3, wherein said encapsulating step flows said fusible layer into a plurality of pores of said non-woven or woven fibrous mat.

6. The method of claim 1, wherein said element precursor comprises a fusible material.

7. The method of claim 1, in which said circuit path is directed by a programmable sewing machine.

8. A method of making a polymeric heating element, comprising; the steps of:

a. providing a reinforcing support layer having a plurality of open pores;

b. sewing an electrical resistance heating material onto said reinforcing support layer to form an element precursor having a circuit path thereon;

c. mechanically deforming at least said circuit path; and d. substantially encapsulating said element precursor within a polymeric material whereby a portion of said polymeric material flows into a portion of said open pores of said reinforcing support layer, while preserving the reinforcing capabilities thereof, wherein the shape of said circuit path is mechanically deformed prior to the encapsulating step (d).

9. The method of claim 8 further comprising liquefying said polymeric material.

10. The method of claim 9, wherein said liquefication step comprises the use of heat or pressure or both.

11. The method of claim 8, wherein said element precursor further comprises a fusible material.

12. The method of claim 11, wherein said fusible material and said polymeric material comprise the same polymeric resin.

13. The method of claim 8, wherein said reinforcing support layer comprises one or more materials selected from the group consisting of: grid, scrim, nonwoven fabric, spunbonded layer, clay, thermosetting sheet film, thermoplastic sheet film, non-woven fiberglass mat, polymer impregnated fabric, raw printed circuit board laminate, polymer or natural organic fabric weave, porous mica-filled plate or sheet and porous ceramic wafer.

14. The method of claim 8, wherein said reinforcing support layer is at least partially fused, melt-bonded or liquefied during said molding step.

15. A method of making an electrical resistance heater, comprising the steps of:

a. providing a sewable support layer;

b. sewing an electrical resistance heating member onto said sewable support layer to form an element precursor having a circuit path thereon;

c. mechanically deforming at least said circuit path; and d. electrically insulating said electrical resistance heating member within a thermally conductive material which is capable of forming a fusion bond with said sewable support layer, wherein the shape of the circuit path is mechanically deformed prior to said electrically insulating step (d).

16. The method of claim 15, wherein said element precursor comprises one or more of the materials selected from the group consisting of: clay, thermoplastic resin, thermosetting resin, glass, ceramic, and printed circuit laminate material.

17. The method of claim 15, wherein said support layer comprises a polymeric material.

18. The method of claim 15, wherein said support layer comprises a metallic film.

19. The method of claim 18, wherein said electrical resistance heating member comprises a wire coated with an electrically insulating coating.

* * * * *